US005511503A

United States Patent [19]

Spanier et al.

[11] Patent Number: 5,511,503

[45] Date of Patent: Apr. 30, 1996

[54] DOWNHAULING APPARATUS AND METHOD FOR USING SAME

[75] Inventors: Barry E. Spanier, Haiku, Hi.; L. Scott Leishman, Huntington Beach, Calif.; Kevin J. McDonald, Haiku, Hi.

[73] Assignee: All West Plastics, Inc., Huntington Beach, Calif.

[21] Appl. No.: 320,305

[22] Filed: Oct. 6, 1994

[51] Int. Cl.[6] ..... B63B 35/79

[52] U.S. Cl. ..... 114/39.2; 114/109

[58] Field of Search ..... 114/39.2, 102, 114/103, 108, 109, 218

[56] References Cited

U.S. PATENT DOCUMENTS

| | | | |
|---|---|---|---|
| 4,699,073 | 10/1987 | Farneti | 114/39.2 |
| 4,977,843 | 12/1990 | Ewert et al. | 114/39.2 |
| 5,239,939 | 8/1993 | Purdy | 114/109 |

FOREIGN PATENT DOCUMENTS

| | | |
|---|---|---|
| 3324900 | 10/1984 | Germany . |
| 3636007 | 5/1988 | Germany . |

OTHER PUBLICATIONS

Abstract of DT 3636007, May 1988.

*Primary Examiner*—Edwin L. Swinehart
*Attorney, Agent, or Firm*—Frank J. Uxa

[57] ABSTRACT

Apparatus for downhauling a sail movably attached to a mast assembly including a mast base having a gripping assembly are disclosed. The sail is coupled to the gripping assembly by a downhaul line adapted to be held at varying points along its length by the gripping assembly to maintain a degree of tension on the sail. In one embodiment, the apparatus comprises a system base adapted to be removably secured to the mast base. A lever arm including a first portion coupled to the system base and adapted to be pivotably moveable to the system base and a second portion coupled to the first portion so that the lever arm has a relaxed configuration and an activated configuration is provided. With the lever arm in the relaxed configuration, the downhaul line passes between the first and second portions. With the lever arm in the activated configuration, the downhaul line located between the first and second portions is prevented from movement relative to the lever arm. By manipulating the lever arm between the relaxed configuration and the activated configuration and moving the lever arm the amount of tension on the sail can be varied to obtain the desired degree of tension on the sail.

20 Claims, 4 Drawing Sheets

16
10
12
18
14
12
48
47
49
47
118
46
40
44
44
42
34
32
24
28
14
26
30

DOWNHAULING APPARATUS AND METHOD FOR USING SAME

BACKGROUND OF THE INVENTION

The present invention relates to apparatus and methods for downhauling a sail. More particularly, the invention relates to apparatus and methods for downhauling a sail which is movably attached to a mast assembly and is coupled to a downhaul line adapted to be held at varying points along its length by a gripping means which is part of the mast assembly.

A sail board or wind surfing craft generally has a single sail. This sail must be placed under tension before use. The sail is generally placed under a high degree of tension to prevent the sail from being deformed by its motion through the air and to facilitate use at high speeds.

Ordinarily, the sail is attached to a mast and then, using a mast base, the sail and mast are attached to the board. The sail often has a sleeve at the leading edge. The sail is movably attached to the mast, for example, by sliding the sleeve over the mast from the top of the mast. A cap at the top of the sleeve eventually limits travel of the sleeve down the mast. An elongated downhaul line is coupled to the sail. A free end of the elongated line is passed through a gripping assembly, often a cleat, attached to the mast base, which is secured to the mast. The gripping assembly allows tension to be applied to the sail by pulling on or downhauling the portion or segment of the downhaul line extending through the gripping assembly. The gripping assembly maintains the tension by preventing the downhaul line from returning through the gripping assembly. Once the sail is tensioned, the mast assembly is attached by the mast base to a mast cup mounted on the board or craft and the assembly is complete.

A substantial amount of force is required to properly tension the sail. If this tensioning was to be done without any mechanical assist, injuries (for example, lower back injuries) and abrasions might result.

Purdy U.S. Pat. No. 5,239,939 discloses a device for downhauling such a sail. However, the disclosed device involves an additional cleat to provide for ratchetting action. This relatively high degree of mechanical complexity increases the cost and maintenance requirements of the system and reduces system reliability. In addition, the fulcrum of the lever used in the Purdy system is located near the center of the lever arm, disadvantageously reducing the mechanical advantage obtained in using such a system.

SUMMARY OF THE INVENTION

New apparatus and methods for downhauling a sail movably attached to a mast assembly have been discovered which reduce the severity of, or even eliminate, many of the problems with prior systems for downhauling such sails. The present apparatus are straightforward in construction, and are easy and convenient to use. No additional cleats or complex ratchetting action are required. In addition, the effective length of the lever arm is increased to provide enhanced mechanical advantage in applying tension to the sail. The present systems can assist sailors in obtaining a higher level of performance from any rig they own. The present methods can be very effectively practiced, for example, to tension a sail precisely, such as within one or two millimeters of the optimum desired. The sailor can advantageously use leverage to make fine tuning adjustments as small as a few millimeters even though the rig is under full tension.

In one broad aspect of the present invention, apparatus for downhauling a sail movably attached to a mast assembly including a mast base having a gripping assembly are provided. The sail is coupled to the gripping assembly by a downhaul line adapted to be held at varying points along its length by the gripping assembly to maintain a degree of tension on the sail. The present apparatus comprise a system base and a lever arm. The system base is adapted to be removeably secured to the mast base (which, in turn, is secured to the mast of the sail), for example, while the present apparatus is used in downhauling the sail. The lever arm includes a first portion and a second portion.

The first portion of the lever arm is coupled to the system base and is adapted to be pivotably moveable relative to the system base. The second portion is coupled to the first portion so that the lever arm has, and can be moved between, a relaxed configuration and an activated configuration. In the relaxed configuration, the elongated downhaul line passes between the first and second portions, while with the lever arm in the activated configuration the elongated line located between the first and second portions is prevented from movement relative to the lever arm. Thus, with the lever arm in the relaxed configuration, the present apparatus is ineffective to increase the downhaul tension on the sail. However, in the activated configuration, the lever arm can be pivotably moved relative to the system base to increase the degree of tension on the sail.

The present apparatus is preferably structured and adapted to be used manually. For example, the lever arm is preferably adapted to be manually moveable between the relaxed configuration and the activated configuration. In addition, the lever arm can be pivotably moved relative to the system base manually.

The first portion of the lever arm preferably has opposing first and second ends, is coupled to the system base at or near the first end and is coupled to the second portion of the lever arm at or near the second end. Thus, the lever arm is preferably coupled at or near one end to the system base to maximize the effective length of the lever arm and the mechanical advantage to be obtained. The second portion of the lever arm preferably has a distal end (extending toward the system base) and an opposing proximal end (which extends away from the system base). In this embodiment, the first portion of the lever arm is coupled to the second portion of the lever arm at or near the distal end of the second portion, again to enhance the effective length of the lever arm.

In a particularly useful embodiment, the first portion of the lever arm defines a passageway through which the downhaul line can pass when the lever arm is in the relaxed configuration. The second portion of the lever arm includes a blocking assembly, more preferably a fluted pin secured to the body of the second portion, which is located relative to the first portion of the lever arm so that when the lever arm is in the activated configuration the blocking assembly cooperates with the first portion of the lever arm to prevent the downhaul line located between the first and second portions from movement relative to the lever arm.

The system base is preferably adapted to be partially placed or located within the mast base, particularly when the present apparatus is being used to apply tension to the sail.

In one embodiment, the system base comprises a common element coupled to the first portion of the lever arm, and preferably an adapter element operatively coupled to the common element and adapted to be removeably secured to the mast base. The common element is more preferably configured to be operatively coupled to a plurality of different adapter elements, each of which is configured to be removeably secured to a differently configured mast base. In this embodiment, the present system is very effectively utilized with any number of differently configured mast bases.

The system base, for example, the common element of the system base, advantageously includes an outwardly extending projection adapted to be placed at least partially in the mast base to at least facilitate the removable securement of the system base to the mast base.

Methods for downhauling a sail movably attached to a mast assembly including a mast base having a gripping assembly are also provided and are included within the scope of the present invention. Such methods are effective when the sail is coupled to a downhaul line the position of which can be altered to alter the tension on the sail. The present methods comprise passing a segment of the downhaul line into and through a lever arm, for example, a lever arm as described elsewhere herein. The downhaul line is held to the mast base by a gripping assembly, for example, a cleat. The lever arm includes first and second portions and may be placed in a relaxed configuration or in an activated configuration, as described herein. The system base coupled to the lever arm is secured to the mast base. The lever arm is placed in the activated configuration. The lever arm is moved, while in the activated configuration, relative to the mast base to increase the length of the downhaul line between the gripping assembly and the lever arm. Thereafter, the lever arm is placed in the relaxed configuration. Preferably, with the lever arm in the relaxed configuration, an additional segment of the downhaul line is passed into and through the lever arm. The placing steps and moving step, and preferably the additional segment passing step, are then repeated, more preferably, until the sail has the desired degree of tension. After this degree of tension has been achieved, the system base is removed from the mast base and the mast assembly is secured to the sail board or wind surfing craft for use. Preferably, the passing, placing and moving steps are performed manually.

The present apparatus and methods are straightforward in construction, easy, effective, convenient and reliable to use and are durable so that they can be employed repeatedly to downhaul sails.

These and other aspects and advantages of the present invention will become apparent in the following detailed description and claims, particularly when considered in conjunction with the accompanying drawings in which like parts bear like reference numerals.

DETAILED DESCRIPTION OF THE DRAWINGS

Figures 1, 7:
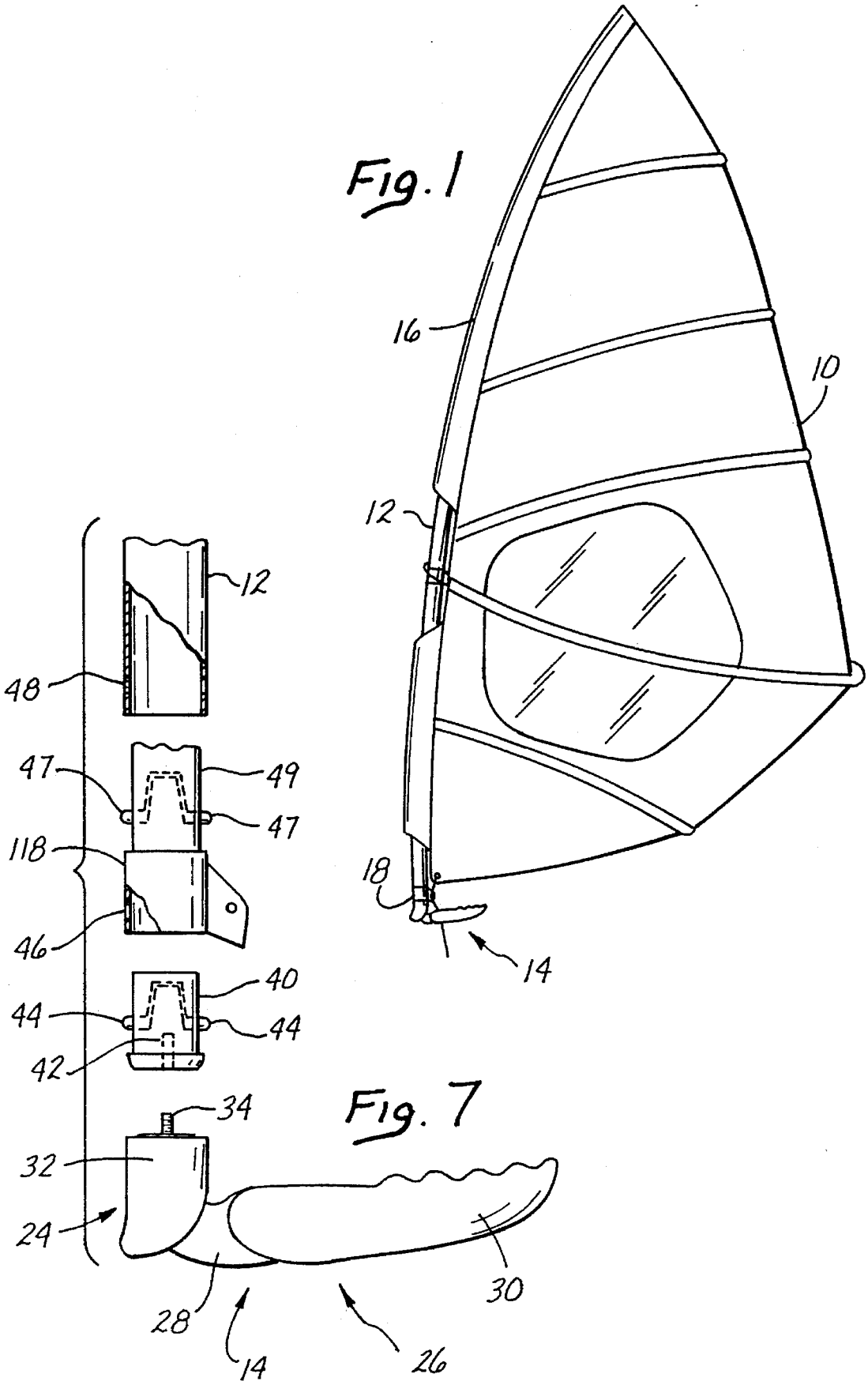
FIG. 1 is an illustration showing an embodiment of the present downhauling apparatus ready for use.
FIG. 7 is an exploded view of an alternate embodiment of the downhauling apparatus of the present invention.

FIG. 1 illustrates a wind surfing sail 10 attached to a sail mast 12 which is ready to be tensioned using the present downhauling system, shown generally at 14. Once the sail 10 is attached to sail mast 12 by passing the mast through sleeve 16, the sail must be downhauled or tensioned in order to be effectively operable. The sail mast 12 is fitted with a mast base 18 which extends out of the bottom of the sail mast. Mast base 18 is equipped with a cleat 20.

Figure 2:
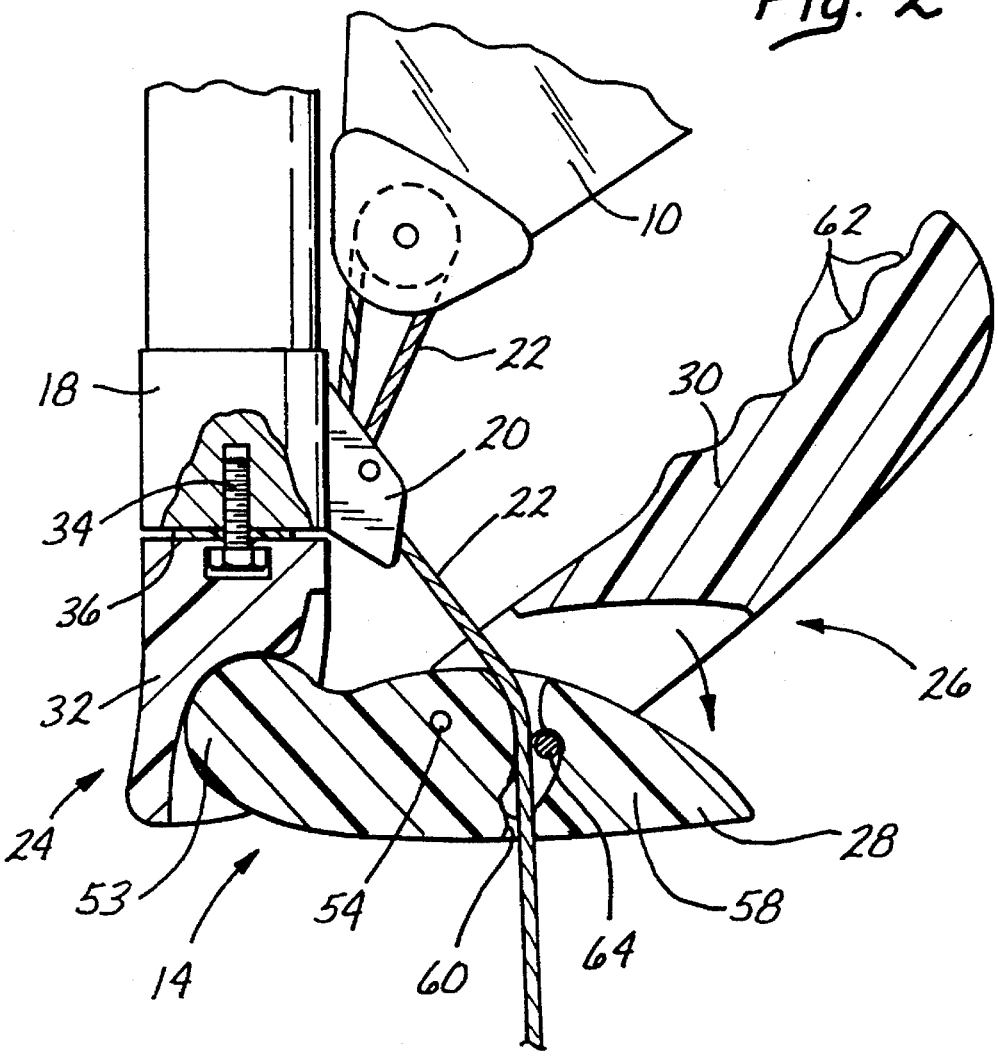
FIG. 2 is a wide view, partly in cross-section, showing the embodiment of the present downhauling apparatus shown in FIG. 1 in use with the lever arm in the relaxed configuration.
Figure 5:
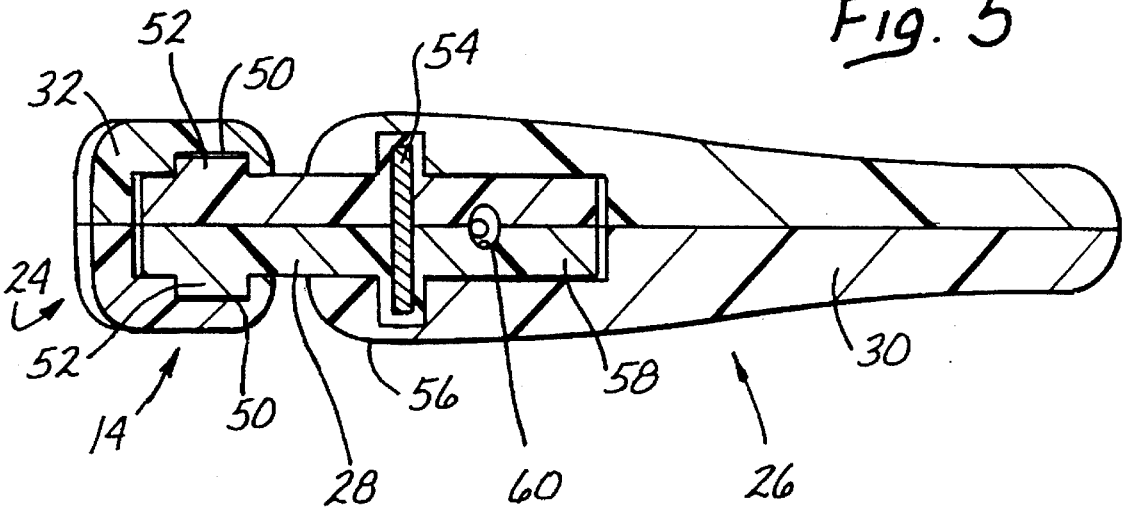
FIG. 5 is a cross-sectional view taken generally along line 5—5 of FIG. 2.

Referring now to FIG. 2, once sail 10 is attached to sail mast 12, downhaul line 22 is used to couple the bottom of the sail to the mast base 18. This is done by joining the downhaul line 22 to the sail 10 and than passing the downhaul line into and through cleat 20 of mast base 18. A substantial length of downhaul line 22 extends beyond cleat 20 away from sail 10.

The present downhauling system 14 includes a system base 24 and a lever arm 26 which includes forward or first portion 28 and a rearward or second portion 30.

The system base 24 includes a base member 32. A threaded bolt 34 is passed through the end wall of the base member 32 which is positioned away from the lever arm 26. Threaded bolt 34 can be placed directly in mast base 18, as shown in FIG. 2, to secure the system base 24 (and the downhauling system 14) to the mast base. This is particularly advantageous when the mast base 18 is configured to accept bolt 34 in sufficiently snug relation to effect the desired securement between the system base 24 and the mast base 18.

However, commonly used mast bases have varying configurations, many of which are not susceptible to being secured directly to bolt 34. In this circumstance, an adapter, such as adapter 40 shown in FIG. 7, is employed. Adapter 40 includes an indent 42 sized and adapted to receive bolt 34 in snug relation, and spring loaded pins 44 adapted to be placed into holes 46 of alternate mast base 118. Thus, the indent 42 of adapter 40 is effective to snugly hold bolt 34 and the spring loaded pins 44 secure the adapter to the alternate mast base 118. In this manner, system base 24 is secured to alternate mast base 118.

Differently configured adapters can be provided to insure securement between system base 24 and differently configured mast bases. All of the adapters are preferably configured to hold bolt 34 in snug relation. Thus, system 14, including system base 24 with bolt 34, can be made to be universally effective regardless of the configuration of the mast base being employed.

FIG. 7 clearly illustrates the attachment of alternate mast base 118 to sail mast 12. Mast base 18 is attached to sail mast 12 in a similar manner. Thus, as shown in FIG. 7, alternate mast base 118 includes an elongated tubular segment 49 which is sized to fit into the hollow space defined by sail mast 12. Alternate mast base 118 is secured to sail mast 12 by spring loaded pins 47 on the alternate mast base passing through appropriately sized and located holes 48 in the elongated tubular segment 46 of the sail mast.

FIGS. 2 to 6 illustrate further details of the construction of system 14. The lever arm 26, and in particular first portion 28, is pivotably moveable relative to base member 32. This pivotable movement occurs around circular indents 50 in base member 32. Circular projections 52 located near first or distal end 53 of first portion 28 are received in indents 50 and are sized and adapted to move relative to the indents but not to escape from the indents.

A pivot pin 54 is provided and allows for limited pivotable movement of first portion 28 relative to second portion 30. Pivot pin 54 is located near the forward end 56 of second portion 30 and at least to some extent near the second or proximal end 58 of the first portion 28. This limited pivotable movement between the first portion 28 and the second portion 30 allows the lever arm 26 to be moved between a relaxed configuration, shown in FIG. 2, and an activated configuration, shown in FIG. 3. The end-to-end-to-end joining of the first portion 28 to the base member 32 and of the second portion 30 to the first portion advantageously provides a relatively long lever arm 26 and a relatively large mechanical advantage when the lever arm is in the activated configuration.

First portion 28 includes or defines a passageway 60 which is sized and adapted to allow the downhaul line 22 to be passed into and through the first portion (by passing the downhaul line into and through the passageway).

The rearward (proximal) or second portion 30 of the lever arm 26 includes finger indents 62 to facilitate the user of the system 14 gripping the lever arm with his/her hand, for example, during a "power stroke" as is discussed hereinafter. In addition, second portion 30 includes a fluted pin 64 which is located to interact with the passageway 60 of first portion 28 as follows. When lever arm 26 is in the relaxed configuration (FIG. 2) fluted pin 64 is sufficiently removed from passageway 60 so that downhaul line 22 can be passed freely into and through the passageway. However, when lever arm 26 is in the activated position (FIG. 3), fluted pin 64 blocks passageway 60 sufficiently so that the downhaul line 22 located in the passageway between the first portion 28 and second portion 30 is prevented from moving relative to the lever arm 26.

System 14 can be operated manually, for example, by a single human user. System 14 can be made from any suitable material of construction or combination of materials of construction. In one very useful embodiment, the base member 32 and lever arm 26 (except for the pivot pin 54 and fluted pin 64 which are preferably made of metal) are made of polymeric material or materials, for example, reinforced polymeric material or materials, such as polycarbonate reinforced or filled with graphite particles or fibers.

With system base 24 secured to mast base 18, as described above, system 14 is operated as follows. Lever arm 26 is manually placed in the relaxed configuration, and the end of the downhaul line 22 extending beyond cleat 20 away from sail 10 is passed into and through passageway 60. The lever arm 26 in the relaxed configuration with the end of the downhaul line 22 located in and beyond passageway 60 is shown in FIG. 2.

Figure 3:
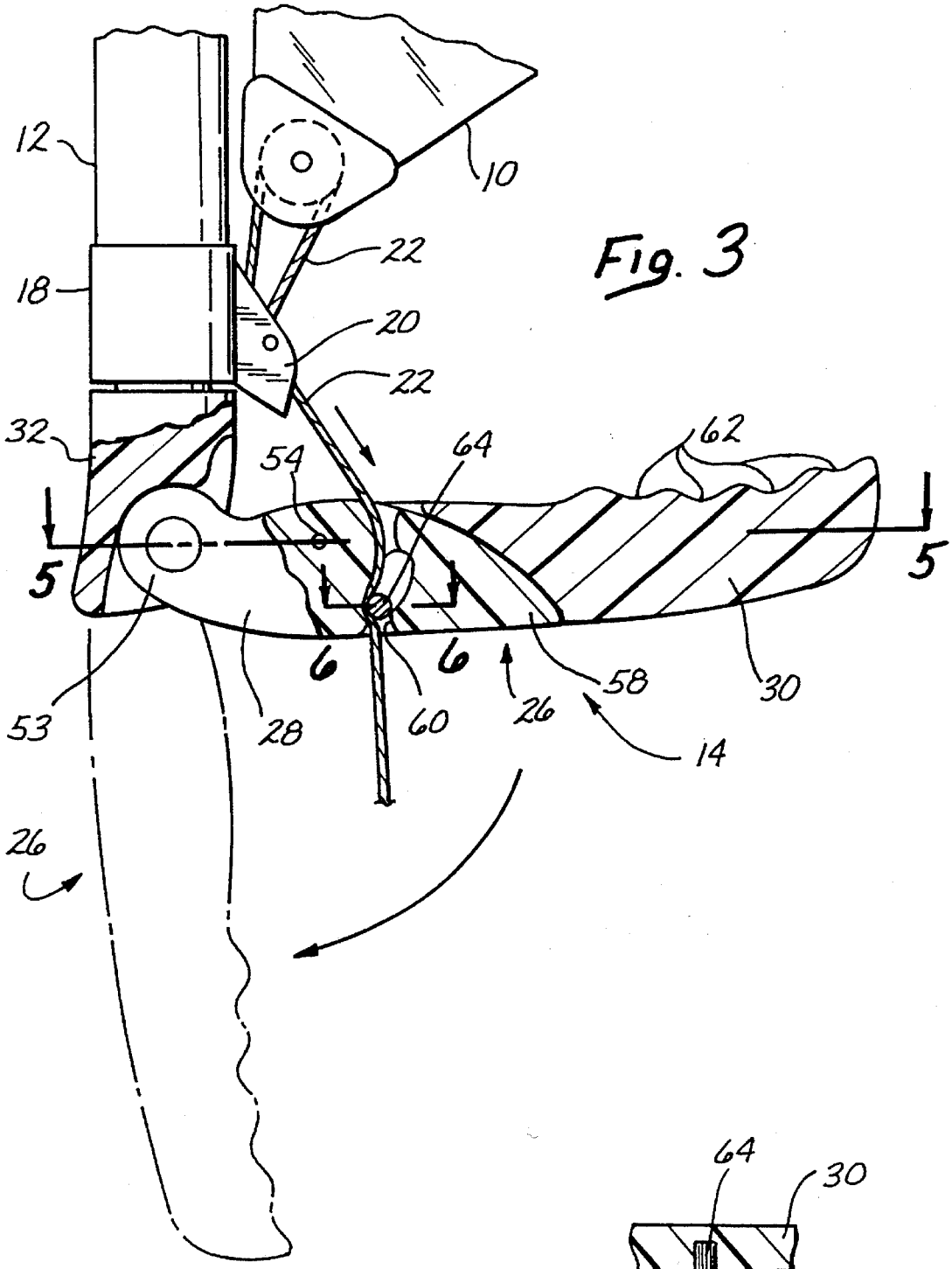
FIG. 3 is a side view, partly in cross-section, showing the embodiment of the present downhauling apparatus shown in FIG. 1 in use with the lever arm in the activated configuration.
Figure 6:
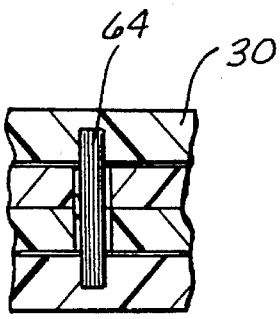
FIG. 6 is a cross-sectional view taken generally along line 6—6 of FIG. 3.

The lever arm 26 is then moved to the activated configuration, as shown in FIG. 3. As noted above, placing the lever arm 26 in the activated configuration causes fluted pin 64 to interact with first portion.28 to prevent the downhaul line 22 located within the lever arm 26 from moving relative to the lever arm. After the lever arm 26 is placed in the activated configuration, the lever arm is manually moved away from sail 10. For example, as shown by the shadow line in FIG. 3, the lever arm 26 in the activated configuration is manually moved through an angle of approximately 90 degrees to the "six o'clock" position. This movement of lever arm 26 causes additional downhaul line 22 to pass through cleat 20. This movement of downhaul line 22 increases the downhaul tension on sail 10 and, in addition, causes more of the downhaul line to be present between cleat 20 and lever arm 26. This movement of the lever arm 26 in the activated position away from sail 10 can be termed the "power stroke" of system 14.

Figure 4:
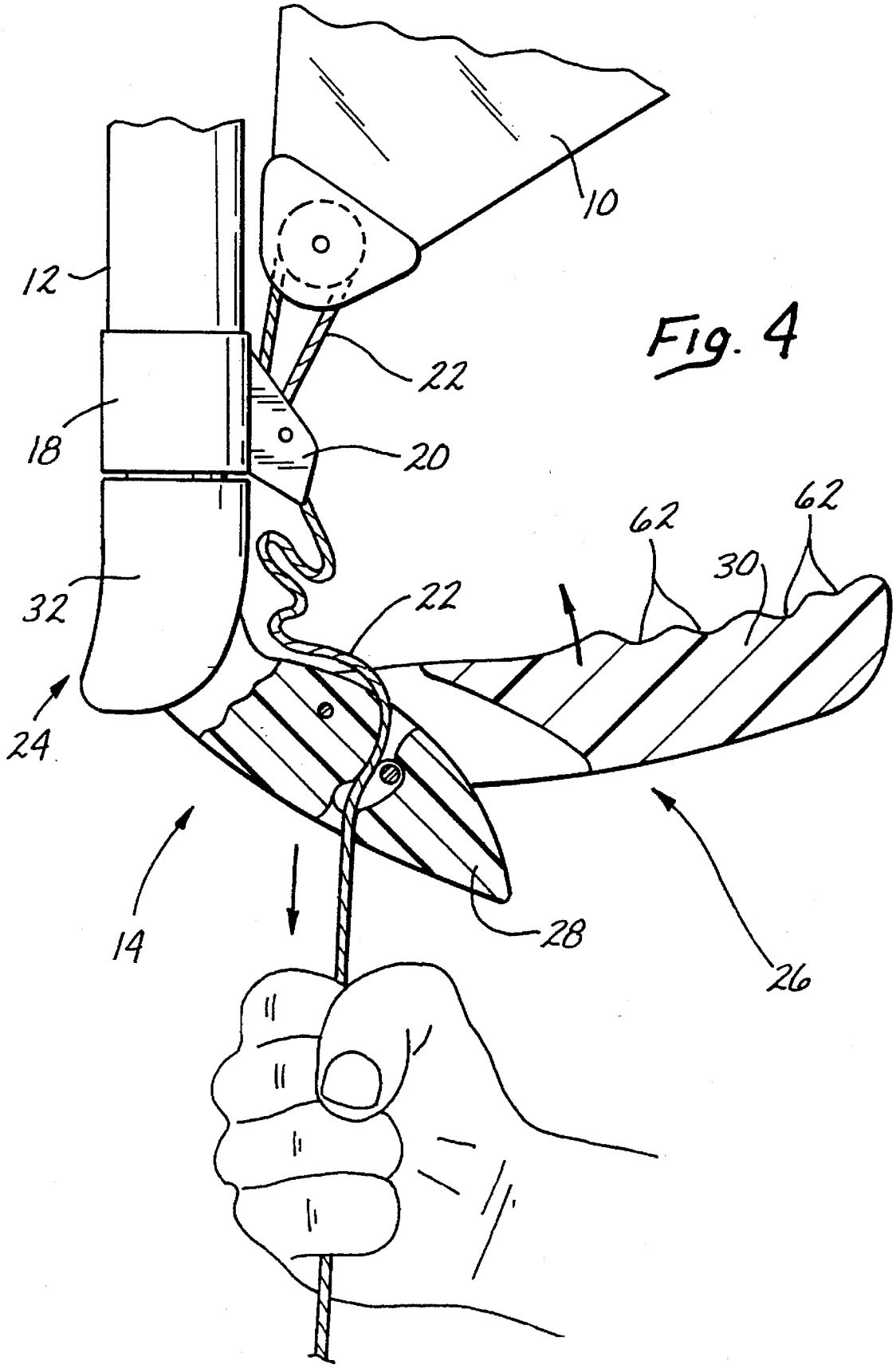
FIG. 4 is a side view, partly in cross-section, showing the embodiment of the present downhauling apparatus shown in FIG. 1 in use with the lever arm being moved into the relaxed configuration.

After this "power stroke", lever arm 26, in the activated configuration is returned to the original position, for example, the "three o'clock" position, as shown in FIG. 3. At this point, lever arm 26 is moved to the relaxed configuration. This can be conveniently done, as shown in FIG. 4, by simultaneously pulling on downhaul line 22 and pushing up on second portion 30. With lever arm 26 in the relaxed position the downhaul line is pulled to remove the slack that was produced during the "power stroke". If the sail 10 is still insufficiently tensioned, the procedure can be repeated. That is, after the downhaul line 22 has been pulled relatively taut, the lever arm 26 is returned to the activated configuration, and the lever arm is moved through another "power stroke". After this "power stroke", the lever arm 26 is moved to the relaxed configuration, as described above. This procedure is repeated until the sail 10 has been tensioned to the desired degree.

The present system 14 is very effective in "fine tuning" the downhaul tension on sail 10. Thus, the degree of tension can be controlled to within one or two millimeters of the optimum tension desired. This "fine tuning" is a particular advantage of the present invention and can be accomplished very conveniently and easily without excessive manual strength or dexterity.

Once the sail 10 has been tensioned to the desired degree, the lever arm 26 is placed in the relaxed configuration and the downhaul line 22 is removed from passageway 60. The system base 24 is removed from the mast base 18. At this point, the sail 10 is ready for use. Thus, the mast base 18 is secured to the windsurf board, in the conventional manner, and the sail 10 can be used as desired. The downhauling system 14, immediately after having been used to downhaul one sail, can be used again to downhaul another sail. Alternatively, system 14 can be easily and conveniently stored between uses.

The present downhauling systems are very straightforward in construction, making such systems convenient, easy and reliable in use. In addition, because the present systems are not complex, they are very reliable and durable, which allows for repeated use over long periods of time. The present systems require no ratchetting action, which can disadvantageously result in undue complexity and substantial maintenance requirements. Moreover, the present downhauling systems are very effectively used with a wide variety of different mast bases, making the present systems substantially universally applicable for downhauling sails. In short, the present systems are straightforward, simple to use, of durable and sturdy construction and usable with a great variety of different sails and mast assemblies.

While this invention has been described with respect to various specific examples and embodiments, it is to be understood that the invention is not limited thereto and that it can be variously practiced within the scope of the following claims.

What is claimed is:

1. An apparatus for downhauling a sail movably attached to a mast assembly including a mast base having a gripping assembly, the sail being coupled to the gripping assembly by a downhaul line adapted to be held at varying points along its length by the gripping assembly to maintain a degree of tension on the sail, said apparatus comprising:

a system base adapted to be removably secured to the mast base;

a lever arm including a first portion coupled to said system base and adapted to be pivotably moveable relative to said system base, and a second portion which extends longitudinally away from said first portion, and is directly coupled to said first portion at a location, said lever arm has a relaxed configuration in which the downhaul line passes between said first and second portions and an activated configuration in which the downhaul line located between said first and second portions is prevented from movement relative to said lever arm and;

a blocking assembly coupled to said lever arm and positioned so that when said lever arm is in said activated configuration said blocking assembly cooperates with said first and second portions to prevent movement of the downhaul line located between said first and second portions relative to said lever arm.

2. The apparatus of claim 1 wherein said second portion is longer than said first portion and said lever arm is adapted to be manually moveable between said relaxed configuration and said activated configuration.

3. The apparatus of claim 1 wherein said first portion has opposing first and second ends and is coupled to said system base at said first end and is coupled to said second portion at or near said second end.

4. The apparatus of claim 1 wherein said second portion has a distal end and an opposing proximal end which extends away from said system base, and said first portion is coupled to said second portion at or near said distal end.

5. The apparatus of claim 1 wherein said first portion defines a passage way through which the downhaul line can pass when said lever arm is in said relaxed configuration.

6. The apparatus of claim 1 wherein said blocking assembly comprises a fluted pin.

7. The apparatus of claim 1 wherein said system base is adapted to be at least partially placed within the mast base.

8. The apparatus of claim 1 wherein said system base comprises a common element coupled to said first portion and an adapter element operatively coupled to said common element and adapted to be removably secured to the mast base.

9. The apparatus of claim 8 wherein said common element is configured to be operatively coupled to a plurality of adapter elements each of which is configured to be removably secured to a differently configured mast base.

10. The apparatus of claim 1 wherein said system base includes an outwardly extending projection adapted to be placed at least partially in the mast base to at least facilitate the removable securement of said system base to the mast base.

11. The apparatus of claim 8 wherein said common element includes an outwardly extending projection adapted to be placed at least partially in the mast base to at least facilitate the removable securement of said system base to the mast base.

12. The apparatus of claim 1 wherein said blocking assembly is located further away from said system base than said location of direct coupling of said first and second portions.

13. The apparatus of claim 5 wherein said blocking assembly is secured to said second portion and is at least partially located in said passageway when said lever arm is in said activated configuration.

14. A method for downhauling a sail movably attached to a mast assembly including a mast base having a gripping assembly, said sail being coupled to said gripping assembly by a downhaul line the position of which can be altered to alter the tension on said sail, said method comprising:

passing a segment of said downhaul line into and through a lever arm of a downhauling apparatus, said downhaul line being held to said mast base by said gripping assembly, said lever arm including a first portion coupled to a system base of said downhauling apparatus and pivotably moveable relative to said system base, and a second portion which extends longitudinally away from said first portion, is directly coupled to said first portion at a location and is movable relative to said first portion so that said lever arm has a relaxed configuration in which said downhaul line passes between said first and second portions and an activated configuration in which said downhaul line located between said first and second portions is prevented from movement relative to said lever arm, said downhauling apparatus further including a blocking assembly coupled to said lever arm and positioned so that when said lever arm is in said activated configuration said blocking assembly cooperates with said first and second portions to prevent movement of said downhaul line located between said first and second portions relative to said lever arm;

securing said system base to said mast base;

placing said lever arm in said activated configuration;

moving said lever arm, in said activated configuration, relative to said mast base to increase the length of said downhaul ling between said gripping assembly and said lever arm; and, thereafter, placing said lever arm in said relaxed configuration.

15. The method of claim 14 which further comprises, with said lever arm in said relaxed configuration, passing an additional segment of said downhaul line into and through said lever arm, and repeating said placing steps and said moving step.

16. The method of claim 15 wherein said placing steps, said moving step and said additional segment passing step are repeated until the sail has the desired degree of tension.

17. The method of claim 14 which further comprises removing said system base from said mast base.

18. The method of claim 14 wherein said passing, placing and moving steps are performed manually.

19. The method of claim 14 wherein said blocking assembly is secured to said second portion and is located further away from said system base than said location of direct coupling of said first and second portions.

20. The method of claim 14 wherein said first portion defines a passageway through which said downhaul line can pass when said lever arm is placed in said relaxed configuration, and said blocking assembly is at least partially located in said passageway when said lever arm is in said activated configuration.

* * * * *